United States Patent [19]

Amthor

[11] Patent Number: 4,731,712

[45] Date of Patent: Mar. 15, 1988

[54] SQUEEZABLE FLASHLIGHT

[75] Inventor: Helmut K. Amthor, Rocky River, Ohio

[73] Assignee: Eveready Battery Company, St. Louis, Mo.

[21] Appl. No.: 940,129

[22] Filed: Dec. 10, 1986

[51] Int. Cl.[4] ..... F21L 7/00

[52] U.S. Cl. ..... 362/189; 362/196; 362/201

[58] Field of Search ..... 362/157, 189, 196, 200, 362/201

[56] References Cited

U.S. PATENT DOCUMENTS

| | | | |
|---|---|---|---|
| 2,762,907 | 9/1956 | Schwartz | 362/201 |
| 3,079,492 | 2/1963 | Bolinger | 362/189 |
| 4,524,409 | 6/1985 | Yakubek | 362/200 |
| 4,559,588 | 12/1985 | Engelson et al. | 362/189 |
| 4,628,418 | 12/1986 | Chambria | 362/189 |
| 4,631,646 | 12/1986 | Spindler | 362/189 |

FOREIGN PATENT DOCUMENTS

| | | | |
|---|---|---|---|
| 1205975 | 9/1970 | United Kingdom | 362/201 |

*Primary Examiner*—Samuel Scott
*Assistant Examiner*—Noah Kamen
*Attorney, Agent, or Firm*—Virgil B. Hill

[57] ABSTRACT

A flashlight includes a flexible housing of mating halves. A lamp and two batteries are arranged such that the lamp terminals are in contact with the battery terminals. The lamp is operated by squeezing the housing which in turn bends a switch member that completes the circuit between the batteries and the lamp.

18 Claims, 6 Drawing Figures

SQUEEZABLE FLASHLIGHT

BACKGROUND OF THE INVENTION

The present invention relates to a construction for a flashlight, and more particularly to a flashlight that is switched on by the user pressing on the casing.

SUMMARY OF INVENTION

The present invention, a flashlight, comprises a flashlight housing, a pair of batteries inside the housing, and a lamp. Each battery has a terminal disposed on an end thereof, and the battery casing of each battery also acts as a terminal. First means are provided for securing at least a portion of the lamp within the flashlight housing.

The flashlight further comprises second means for retaining the batteries in an offset side-by-side relationship within the housing and in a relationship with respect to the lamp such that a central contact terminal of the lamp contacts a first terminal of a first of the batteries and a cylindrical contact of the lamp contacts a second terminal of the second of the batteries, where the polarity of the second terminal is opposite the polarity of the first terminal. In addition, third means are provided for electrically insulating the casings of the batteries from each other while they are in their offset side-by-side relationship, and fourth means are provided for electrically connecting the batteries so that current flows through the lamp. The fourth means is rendered operative when force is applied to a portion of the flashlight housing that has at least limited flexibility.

The flashlight disclosed herein reguires only a very few parts, and can be automatically assembled, thus making it very low in cost. It is therefore possible to market the flashlight as being disposable after the cells are discharged.

DESCRIPTION OF THE PREFERRED EMBODIMENTS

Figure 1A:
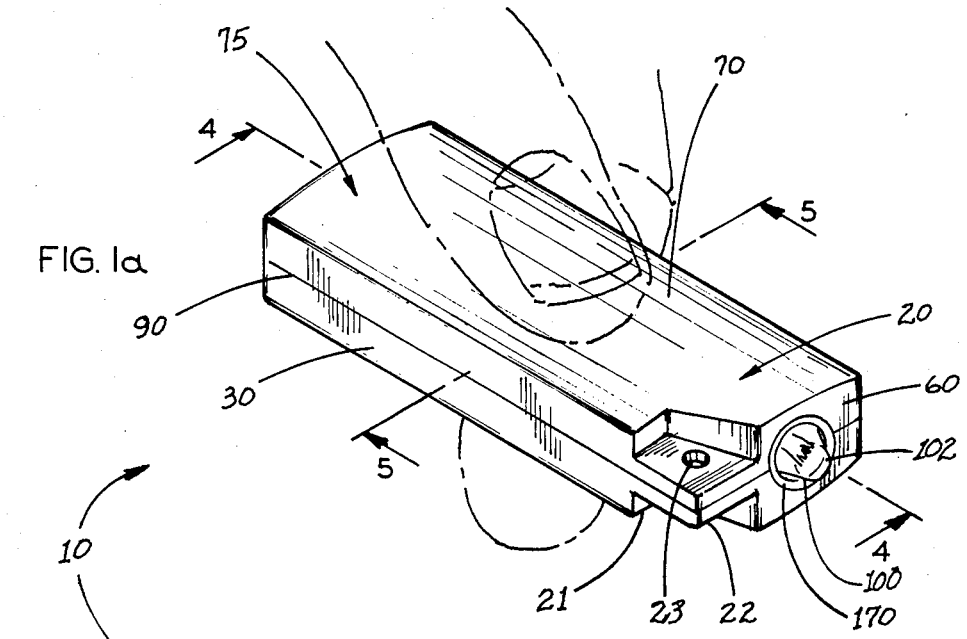
FIGS. 1A and 1B respectively show upper and lower perspective views of the flashlight disclosed herein.
Figure 1B:
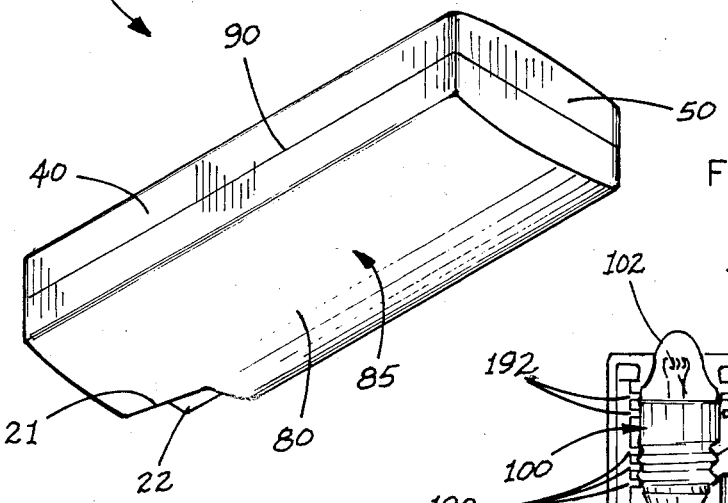

FIGS. 1A and 1B show the external configuration of a flashlight 10, which generally comprises a housing 20 defined by a top surface 70 and a bottom surface 80. Surfaces 70 and 80 are joined by sidewalls 30 and 40, rear wall 50 and front wall 60. Housing 20 can be formed in other shapes than that shown in the figures, such as oval or rectangular, depending upon the designer's aesthetic preferences and the requirements for proper and efficient functioning of the flashlight.

The geometry of housing 20 is interrupted by a notch 21 that accommodates a tab 22. Tab 22 defines a hole 23 so that flashlight 10 can be conveniently attached to a key chain or the like. Alternatively, a tab or other projection (not shown) can be affixed to rear wall 50 and a hole can be defined in the tab or projection for the same purpose. The preferred location for tab 22 is as shown in the figures, since it allows easier manipulation and orientation of flashlight 1 for illumination of a keyhole or the like.

Figure 3:
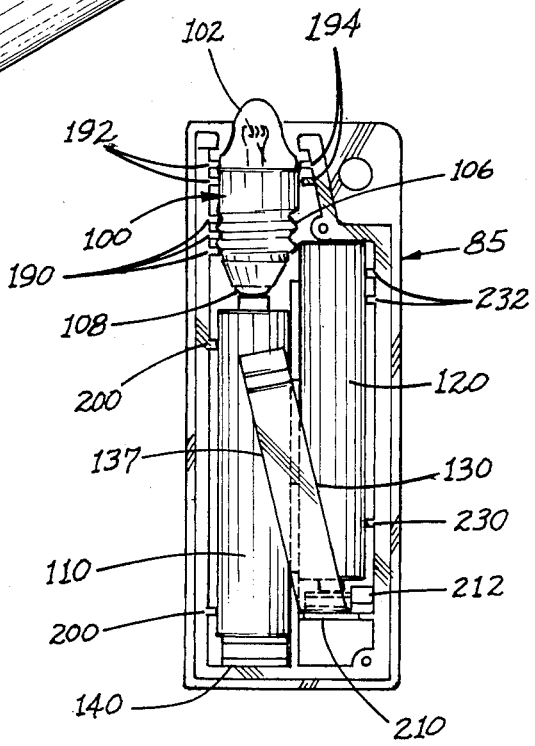
FIG. 3 shows a plan view of the arrangement of the internal components of the flashlight in one housing half.
Figure 2:
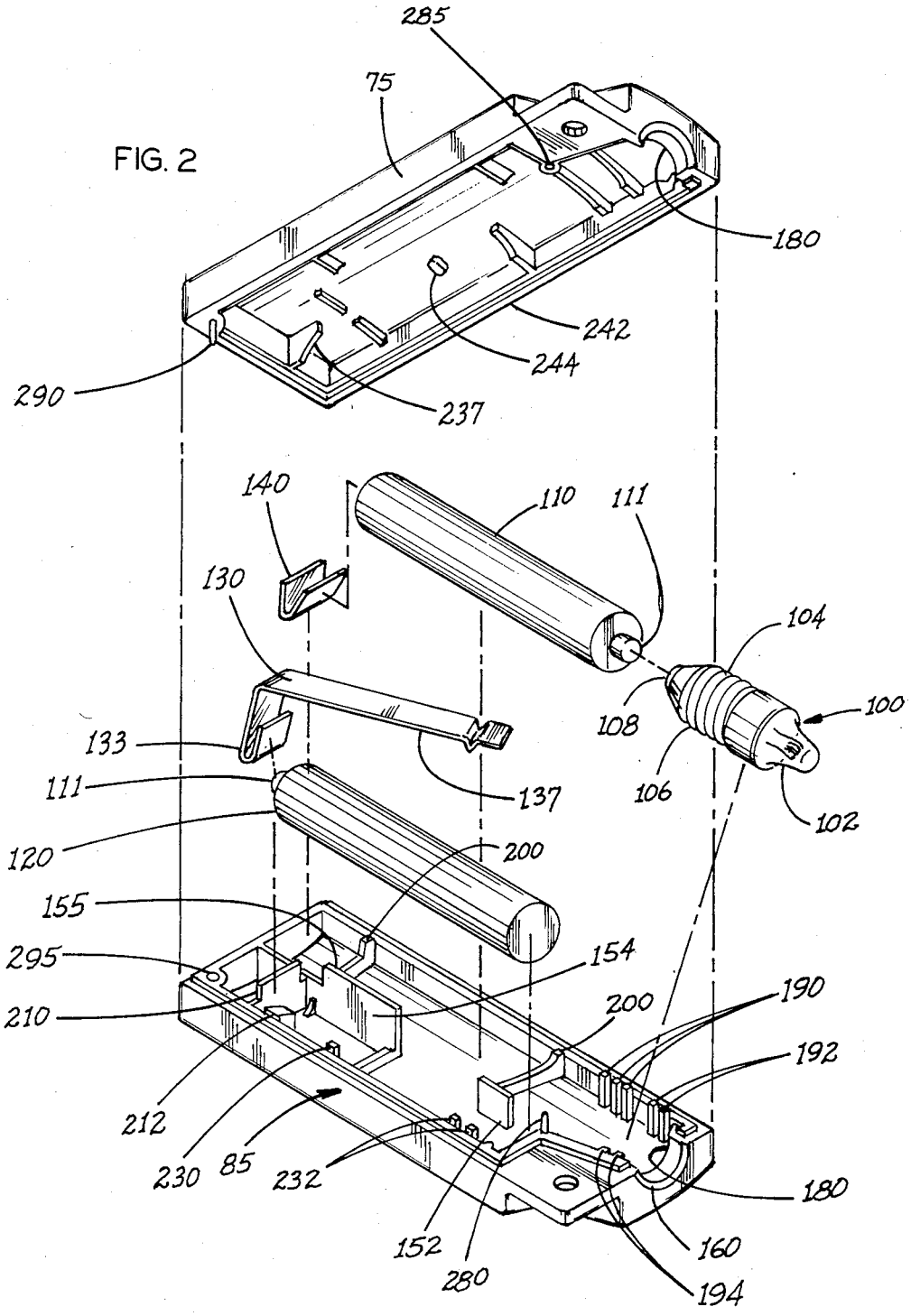
FIG. 2 shows an exploded perspective view of the flashlight of FIG. 1, illustrating the components of the flashlight and the internal configuration of each of the flashlight housing halves.

The housing is formed from two housing halves 75 and 85, which are joined along a parting line 90 that divides sidewalls 30 and 40, rear wall 50 and front face 60. FIG. 2 shows housing halves 75 and 85 after being separated along parting line 90. Depending upon the particular shape of housing 20, parting line 90 can also be located at a position that tends to make it less visible, such as at the intersection of two surfaces that define portions of the housing 10. As shown in FIGS. 2 through 5, the components of the flashlight 10 comprise lamp 100, first battery 110, second battery 120, contact arm 130 and biasing means 140, with the components being assembled in housing half 85 (FIG. 3). The relationship and function of these components is described in detail below.

Each of first battery 110 and second battery 120 is cylindrical and has a central terminal 111 located along the central axis of the battery and at one end thereof. The central terminal 111 is insulated from the battery's conductive casing since the conductive casing acts as the battery's second terminal. The cells preferably are of standard size, with sizes AAAA, AAA, AA or N for example being suitable, as are equivalent cell sizes of other chemical systems. The present embodiment uses AAAA alkaline cells.

Lamp 100 comprises a clear or translucent lamp bulb 102 joined to a lamp base 104. Lamp base 104 further comprises a cylindrical, electrically conductive contact 106 that terminates in and is electrically insulated from a central, electrically conductive contact 108.

Means are provided for keeping batteries 110 and 120 electrically isolated from each other in the housing 20. Such means can be, for example, one dividing wall, or a plurality of dividing walls 152 and 154, which are integrally fastened to the inside of bottom surface 80. In addition, ribs 200 are formed in housing half 85 and are located a distance from dividing walls 152 and 154 that is smaller than the diameter of battery 110, thereby yielding an interference fit that securely holds battery 110 in housing half 85. Similarly, ribs 230 and 232, which are formed in housing half 85, are located a distance from dividing walls 152 and 154 that is smaller that the diameter of battery 120, thereby yielding an interference fit that securely holds battery 120 in housing half 85.

A semicircular cutout 160 in housing half 85 corresponds to a similar cutout in housing half 75 to provide an aperture 170 to allow light from lamp bulb 102 to be projected from housing 20. In the specific embodiment shown, lamp bulb 102 is configured so that the portion distal from lamp base 104 necks down to a diameter narrower than the portion proximate lamp base 104. This configuration allows the portion of lamp bulb 102 distal from lamp base 104 to protrude through aperture 170. A chamfered seat 180 located about the periphery of aperture 170 mates with the necked-down portion of lamp bulb 102.

A plurality of ribs 192 and 194 (FIGS. 2 and 3) are respectively located in housing half 85. The distance between ribs 192 and 194 is less than the diameter of lamp base 104, thereby yielding an interference fit that securely holds lamp 100 in housing half 85.

As shown in FIGS. 2 and 3, cutout 160 and a plurality of projections, or ribs 190, cooperate to locate the central contact 108 of lamp 100 over the central terminal 111 of first battery 110. It has been found that with commercially available lamps the distance from central contact 108 to the intersection of bulb 102 and lamp base 104 can vary up to one eighth of an inch, and that the overall length of the lamp also can vary significantly. In order to accommodate these variations, it is preferable to include in housing 20 means for biasing the central contact 108 and the central terminal of battery 110 toward each other. In the embodiment shown in the figures, such biasing means, denominated 140, is located between first battery 110 and that portion of rear wall 50 as is included in housing half 85. Biasing means 140 urges terminal 111 of battery 110 toward central contact 108, while seat 180 prevents further movement of lamp 100. As a result, central contact 108 is placed firmly in physical and electrical contact with the central terminal 111 of first battery 110, despite significant variations in the dimensions of lamp 100.

Biasing means 140 can take any of a variety of forms, although in the specific embodiment shown biasing means 140 is made from a strip of resilient material, such as copper plated steel, bent through a U-shaped arc and pressed into the gap between first battery 110 and the inner surface of that portion of rear wall 50 on housing half 85. In that gap, biasing means 140 also can be, for example, a V shaped strip of resilient material, a resilient ball, a disk, or a spring. As an alternative, biasing means 140 can be a resilient washer placed between lamp 100 and casing 20. However, if lamps having reasonably uniform dimensions can be obtained, it is possible to dispense with such biasing means.

Referring to FIG. 2, there is shown resilient and electrically conductive contact arm 130, which has a first portion 133 integrally joined to a second cantilevered arm portion 137. First portion 133 in the specific embodiment shown has the same U-shaped configuration as biasing means 140. Aside from being resilient and conductive, it is preferable for contact arm 130 to be made from a corrosion resistant material such as copper plated steel. To make contact arm 130, it is preferable first to form it from a strip of material, rather than to blank it from a sheet, and then form first portion 133 by bending one end of 133 through an arc of 180°. First portion 133 is pressed into the gap between the central terminal 111 of second battery 120 and a bulkhead 210. Bulkhead 210 is integrally joined to the inside of bottom surface 80, to dividing wall 154, and to the inner surface of that portion of sidewall 30 on housing half 85. Accordingly, first portion 133 performs a function similar to biasing means 140, in that it urges battery 120 away from rear wall 50, and also maintains firm electrical contact between the central terminal 111 of battery 120 and cantilevered arm portion 137. It is of course also possible to form contact portion 133 into a V-shape or any other shape suitable to perform the functions just described.

It should also be noted from the figures that the location of bulkhead 210 in cooperation with first portion 133 results in offsetting second battery 120 along its axis relative to first battery 110 such that batteries 110 and 120 are in an offset side by-side relationship. As a result, the casing of second battery 120, which acts as the battery's second terminal, overlaps cylindrical contact 106 of lamp 100. In addition, referring to FIG. 3, ribs 190 and ribs 232, located on the inner surface of that portion of sidewall 40 contained on housing half 85, cooperate to urge together cylindrical contact 106 and the casing of second battery 120, so as to yield physical and electrical contact between these two members.

Apart from serving to bias battery 120, first portion 133 of contact arm 130 also provides support for second cantilevered arm portion 137. Referring to FIG. 3, it can be seen that cantilevered arm portion 137 extends diagonally over dividing wall 154 and terminates over first battery 110. Although cantilevered arm portion 137 is biased away from first battery 110, application of a sufficient amount of force to cantilevered arm portion 137 causes it to flex and thereby contact the casing of battery 110. This contact results in a closed circuit being created such that current can flow from the first central terminal of first battery 110 to the second terminal of battery 120 via central contact 108 and cylindrical contact 106 of lamp 100, and then from the first central terminal of second battery 120 to the second terminal of battery 110 via first portion 133 and second cantilevered arm portion 137 of contact arm 130. This current flow of course illuminates lamp 100.

The biasing of cantilevered arm portion 137 away from first battery 110 can result simply from the inherent resiliency of the material comprising contact arm 130. However, due to the relatively long length of contact arm 130 and the desire to fabricate contact 130 from relatively thin strip material for reasons of cost, it is preferable to provide means for biasing second cantilevered arm portion 137 away from first battery 110. An effective embodiment of such means is depicted in FIG. 2, which shows a support tab 155 integrally attached to and projecting above dividing wall 154. Support tab 155 serves to hold cantilevered arm portion 137 away from first battery 110, and since it shortens the moment arm from the free end of arm portion 137, tab 155 also serves to increase the amount of force needed to cause cantilevered arm portion 137 to flex and contact the casing of battery 110.

FIGS. 2 and 3 show positioning block 212, which is approximately located against that end of battery 120 having central terminal 111. Positioning block 212 prevents any substantial movement of battery 120 toward rear wall 50, as could occur when flashlight 10 is inadvertantly dropped by the user. Without positioning block 212, such movement could cause first portion 133 to be deflected beyond its elastic limit, thereby deforming first portion 133 and possibly breaking the contact between first portion 133 and central terminal 111 of battery 120.

A similar function is preformed by tab 237, which is located as shown in FIG. 2 inside housing half 75. When housing halves 75 and 85 are mated, tab 237 approximately rests against that end of battery 110 not having central terminal 111. Tab 237 prevents any substantial movement of battery 110 toward rear wall 50 when flashlight 10 is dropped, which could cause biasing means 140 of the type shown in the drawings to deform, thereby possibly breaking the contact between central terminal 111 of battery 110 and central contact 108 of lamp 100.

Figure 4:
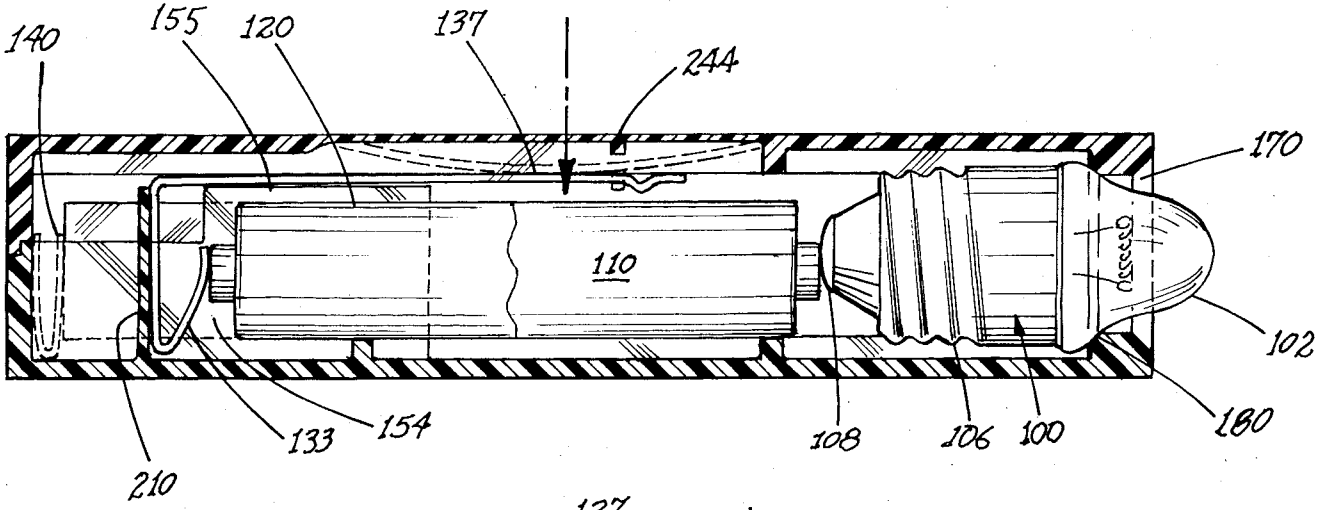
FIG. 4 shows a sectional view of the flashlight shown in FIG. 1A, taken along Section line 4—4.
Figure 5:
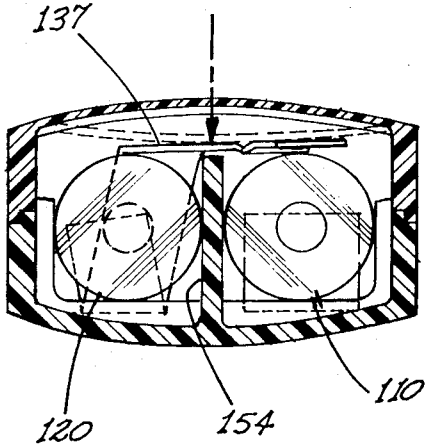
FIG. 5 shows a sectional view of the flashlight shown in FIG. 1A, taken along Section line 5—5.

From the drawings, it can be seen that after assembly, cantilevered arm portion 137 is disposed under top surface 70 of housing 20. The portion of top surface 70 disposed over cantilevered arm portion 137 should be of at least limited flexibility (as by making the portion from a slightly resilient material) so that when pressure is applied to top surface 70, that surface deforms somewhat (as shown in FIGS. 4 and 5), which causes cantilevered arm portion 137 to flex and contact the casing of battery 110, thereby lighting lamp 100. To achieve the desired limited flexibility and also for reasons of cost, it is preferred to make housing 20 from a somewhat resilient plastic. The housing 20 in the preferred embodiment is made from a copolymer of propylene sold under the name "Polyfort" by A. Schulman, of Akron, Ohio.

The amount of force and deformation needed to close the lamp circuit is affected by tab 242 and projection 244, which as shown in FIG. 2 are located in housing half 75. When housing halves 75 and 85 are assembled, tab 242 rests approximately against battery 110 and projection 244 overlies cantilevered arm portion 137. Thus, as pressure is applied to top surface 70, tab 242 tends to prevent deflection of that portion of top surface 70 between tab 242 and front wall 60. The net result is to increase the amount of force needed to close the lamp circuit relative to the case where tab 242 is omitted. Also, when pressure is applied to top surface 70, projection 244 urges cantilevered arm portion 137 against battery 110 to close the lamp circuit. Thus the presence of projection 244 results in the need for less deformation of top surface 70 to close the lamp circuit relative to the case where projection 244 is omitted. In addition, since top surface 70 in the preferred embodiment is curved, dimensional variations in cantilevered arm portion 137 could change the amount of deflection needed to close the lamp circuit. Projection 244 thus serves to avoid this potential problem.

To assemble flashlight 10, components 100, 110, 120, 130 and 140 are press-fit into their appropriate locations in housing half 85, either manually or by use of automatic assembly equipment. Housing half 75 is then placed over half 85. Proper positioning of the housing halves is aided by pin 280 of housing half 85, which engages bore 285 in housing half 75, and by pin 290 of housing half 75, which engages bore 295 in housing half 85. Proper positioning of housing halves 75 and 85 is further aided by providing, for example, a step joint between the housing halves, as is illustrated by FIGS. 4 and 5, or a tongue and groove joint. After the housing halves are properly positioned, they are permanently fastened and sealed, as by ultrasonic welding.

In lieu of using dividing walls 152 and 154, it is possible to cover either cell 110 or cell 120 with an insulative covering, such as a shrink film, at least in the region where they are likely to make contact. If such insulating means is employed, there of course should be no insulative covering in the regions where cell 120 contact cylindrical contact 106, and where cantilevered arm portion 137 contacts battery 110.

I claim:

1. A flashlight comprising:

a flashlight housing;

a pair of batteries within the housing, each battery having a terminal disposed on an end thereof and a terminal defined by a battery casing;

a lamp including a body comprising a central contact terminal disposed at an end thereof and a generally cylindrical casing terminal;

first means for securing at least a portion of the lamp within the flashlight housing;

second means for retaining the batteries in an offset side-by-side relationship within the housing and in a relationship with respect to the lamp such that said central contact terminal of the lamp contac. a first said terminal of a first of the batteries and said cylindrical casing terminal of the lamp contacts a second said terminal of the second of the batteries, the second terminal having a polarity opposite to the first terminal;

third means for electrically insulating the casings of the batteries from each other; and fourth means for electrically connecting the batteries so that current flows through the lamp, said fourth means being rendered operative when force is applied to a portion of said housing having at least limited flexibility.

2. The flashlight housing as in claim 1, wherein the fourth means comprises a resilient conductive contact arm electrically connected to the terminal of the second of the batteries disposed on an end thereof, which contact arm extends over the casing of the first of the batteries, wherein the contact arm is located under the portion of the flashlight housing that has at least limited flexibility, so that when force is applied to the flexible portion the contact arm is urged against and contacts the casing of the first of the batteries.

3. The flashlight as in claim 1, wherein the first terminal of the first of the batteries is the terminal disposed on an end thereof and the second terminal of the second of the batteries is the casing of the second of the batteries.

4. The flashlight as in claim 3, further comprising fifth means for biasing the central contact terminal of the lamp and the first terminal of the first of the batteries toward each other.

5. The flashlight as in claim 4, wherein the fifth means comprises a first strip of bent resilient material in the form of an arc.

6. The flashlight as in claim 5, wherein the first strip of bent resilient material is in the form of a U-shaped arc.

7. The flashlight as in claim 3, further comprising sixth means for biasing the second of the batteries, the sixth means being in contact with the terminal of the second of the batteries disposed on an end thereof, wherein the fourth means comprises a resilient conductive contact arm extending over the casing of the first of the batteries and under the portion of the flashlight housing that has at least limited flexibility, and wherein the contact arm is electrically connected to the sixth means.

8. The flashlight as in claim 7, wherein the sixth means comprises a second strip of bent resilient material in the form of an arc, and wherein the resilient conductive contact arm is integrally connected to the second strip.

9. The flashlight as in claim 8, wherein the second strip of bent resilient material is in the form of a U-shaped arc.

10. The flashlight as in claim 3, wherein the second means includes at least one projection inside the housing that urges the cylindrical contact of the lamp toward the casing of the second of the batteries.

11. The flashlight as in claim 1, wherein the third means for electrically insulating the casings of the batteries from each other comprises a dividing wall located in the flashlight housing between the batteries.

12. The flashlight as in claim 2, further comprising seventh means for biasing the resilient conductive contact arm away from the casing of the first of the batteries.

13. The flashlight as in claim 12, wherein the seventh means comprises a support tab that urges the resilient conductive contact arm away from the casing of the first of the batteries.

14. The flashlight as in claim 11, wherein the fourth means comprises a resilient conductive contact arm electrically connected to the terminal of the second of the batteries disposed on an end thereof, which contact arm extends over the casing of the first of the batteries, wherein the contact arm is located under the portion of the flashlight housing having at least limited flexibility, so that when force is applied to the flexible portion the contact arm is urged against and contacts the casing of the first of the batteries.

15. The flashlight as in claim 14, further comprising seventh means for biasing the resilient conductive contact arm away from the casing of the first of the batteries.

16. The flashlight as in claim 15, wherein the seventh means comprises a support tab, mounted on the dividing wall, to urge the resilient conductive contact arm away from the casing of the first of the batteries.

17. The flashlight as in claim 1, wherein the lamp bulb is configured so that a portion distal from the base section necks down to a diameter narrower than a portion proximate to the base section, and the first means comprises an aperture in the housing having a chamfered seat about its periphery that mates with the necked-down portion of the lamp bulb.

18. A flashlight comprising:

a flashlight housing, wherein a portion of the housing has at least limited flexibility;

a pair of batteries in the housing, each battery having a first terminal disposed on an end of the battery, which terminal is insulated from a casing of the battery that is conductive and that acts as a second terminal of the battery;

a lamp having a lamp bulb fastened to a base section that comprises a first cylindrical contact terminal terminating in and insulated from a second central contact terminal, the lamp bulb being configured so that a portion distal from the base section necks down to a diameter narrower than a portion proximate to the base section;

the housing defining an aperture having a chamfered seat about its periphery that mates with the necked-down portion of the lamp globe so as to secure the base section of the lamp within the flashlight housing;

means for retaining the batteries in an offset side-by-side relationship within the housing and in a relationship with respect to the lamp such that the second contact terminal of the lamp contacts the first terminal of a first of the batteries and the first cylindrical contact of the lamp contacts the casing of the second of the batteries;

a dividing wall located in the flashlight housing between the batteries that electrically insulates the casings of the batteries from each other;

a resilient conductive contact arm electrically connected to the first central terminal of the second of the batteries, which contact arm extends over the casing of the first of the batteries, wherein the contact arm is located under the portion of the flashlight housing of at least limited flexibility; and a support tab, mounted on the dividing wall under the resilient conductive contact arm, which holds the contact arm away from the casing of the first of the batteries.

* * * * *